US008757847B2

(12) United States Patent
Seff et al.

(10) Patent No.: US 8,757,847 B2
(45) Date of Patent: Jun. 24, 2014

(54) PEDESTAL LIGHT ASSEMBLY

(75) Inventors: Paul David Seff, Williamsburg, VA (US); Alston Gareth Brooks, Grafton, VA (US)

(73) Assignee: Eaton Corporation, Cleveland, OH (US)

( * ) Notice: Subject to any disclaimer, the term of this patent is extended or adjusted under 35 U.S.C. 154(b) by 203 days.

(21) Appl. No.: 13/537,152

(22) Filed: Jun. 29, 2012

(65) Prior Publication Data

US 2014/0003051 A1 Jan. 2, 2014

(51) Int. Cl.
*F21V 3/00* (2006.01)

(52) U.S. Cl.
USPC ..... 362/311.02; 362/153.1; 362/192

(58) Field of Classification Search
USPC ..... 362/249.02, 153.1, 267, 192, 276
See application file for complete search history.

(56) References Cited

U.S. PATENT DOCUMENTS

| | | | | |
|---|---|---|---|---|
| 7,626,509 | B2 * | 12/2009 | Dean | 340/691.8 |
| 7,828,463 | B1 * | 11/2010 | Willis | 362/276 |
| 8,104,929 | B2 * | 1/2012 | Kovalchick et al. | 362/294 |
| 8,172,934 | B2 * | 5/2012 | Hashizume | 106/404 |
| 2008/0144316 | A1 * | 6/2008 | Newton et al. | 362/249 |
| 2009/0152821 | A1 * | 6/2009 | Bodmann et al. | 277/608 |

* cited by examiner

*Primary Examiner* — Ali Alavi
(74) *Attorney, Agent, or Firm* — Eckert Seamans Cherin & Mellott, LLC; Kirk D. Houser

(57) ABSTRACT

Systems and other embodiments associated with a light assembly are described. According to one embodiment, a system includes a substrate enclosed in a housing, where the housing prevents intrusion of environmental contaminants. At least one light emitting diode (LED) is mounted to the substrate. The substrate may be a printed circuit board. The LED is configured to receive direct current (DC) power. The system further includes a driver mounted to the substrate. The driver controls the LED. The driver is configured to receive analog current (AC) power. The driver converts the AC power to DC power.

18 Claims, 4 Drawing Sheets

PEDESTAL LIGHT ASSEMBLY

BACKGROUND

Marine power pedestals provide light to an area of dock and access to utilities for docked marine vessels. Standard marine power pedestals have a separate driver to power light sources (e.g., incandescent, sodium, light emitting diodes (LEDs)). Using separate components causes light assemblies to be larger and bulkier. Furthermore, a light assembly using separate components requires additional linking components to integrate the separate components. For example, a separate driver integrated with the light assembly requires additional wiring. Fabricating separate components is also more expensive and time consuming.

SUMMARY

In one embodiment, a system includes a substrate located in a housing, where the housing prevents intrusion of environmental contaminants. At least one light emitting diode (LED) is mounted to the substrate. The substrate may be a printed circuit board. The LED is configured to receive direct current (DC) power. The system further includes a driver mounted to the substrate. The driver controls the LED. The driver is configured to receive analog current (AC) power. The driver converts the AC power to DC power.

In one embodiment, a light assembly includes a sealed housing that prevents intrusion of environmental contaminants. The light assembly also includes a substrate mounted within the sealed housing. The substrate has at least one LED and a driver. The LED is configured to receive DC power. The driver is provided AC power. The driver is connected to AC power with pigtails. The driver has an arrester to protect the LED from a lightning strike.

BRIEF DESCRIPTION OF THE DRAWINGS

The accompanying drawings, which are incorporated in and constitute a part of the specification, illustrate various systems, methods, and other embodiments of the disclosure. It will be appreciated that the illustrated element boundaries (e.g., boxes, groups of boxes, or other shapes) in the figures represent one embodiment of the boundaries. One of ordinary skill in the art will appreciate that in some embodiments one element may be designed as multiple elements or that multiple elements may be designed as one element. In some embodiments, an element shown as an internal component of another element may be implemented as an external component and vice versa. Furthermore, elements may not be drawn to scale.

DETAILED DESCRIPTION

The light assembly described herein includes a printed circuit board (PCB) having both a driver and a light source such as LEDs. This simplifies the fabrication of the light assembly and reduces the need for additional linking components (e.g., wiring) because the driver and a bank of LEDs is fabricated together. Furthermore, the light assembly is also configured to allow LEDs to be placed on either side of the light assembly. The light assembly may be configured to allow LEDs to be affixed to both sides of the PCB such that light can be emitted 360° around the PCB. The light assembly is described in a marine context, such as in a marine power pedestal. However, the light assembly may be used in a multitude of environments (e.g., home and building, recreational vehicle park, and so on).

Figure 1:
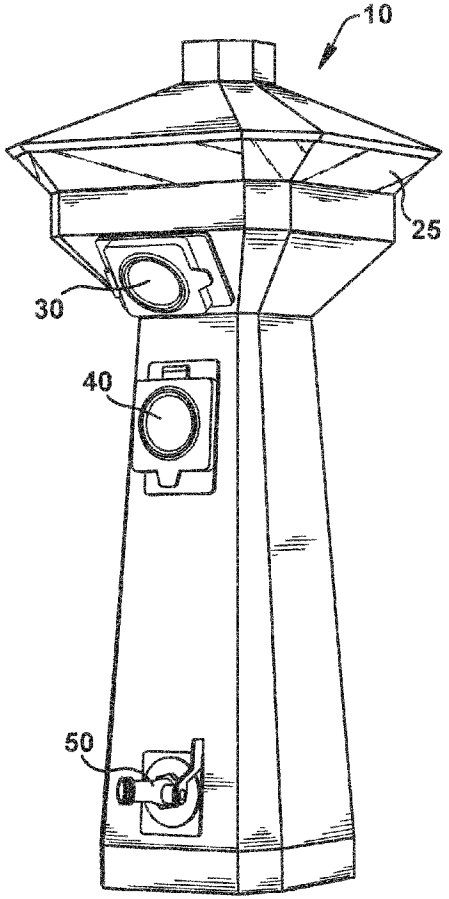
FIG. 1 is a perspective view of one embodiment of a marine power pedestal that includes a light assembly with light lenses.

FIG. 1 illustrates a power pedestal 10 that includes one embodiment of a light assembly (not shown) enclosed by light lenses 25. The light lenses 25 allow light to escape from the interior of the power pedestal 10. As will be described in more detail below, the light assembly includes LED lights affixed to a printed circuit board having a light driver.

The power pedestal 10 also has multiple ports that yield access to utilities such as power, cable, phone, internet, water, and sewage. For example, one or more power receptacles are housed in the receptacle hub 30 to provide access to electrical infrastructure. An access unit 40 may provide access to a circuit breaker, cable jacks, phone jacks, internet jacks and/or other media outlets. In addition to electric utilities, the power pedestal 10 has a valve 50 to provide access to fresh water.

Figure 2:
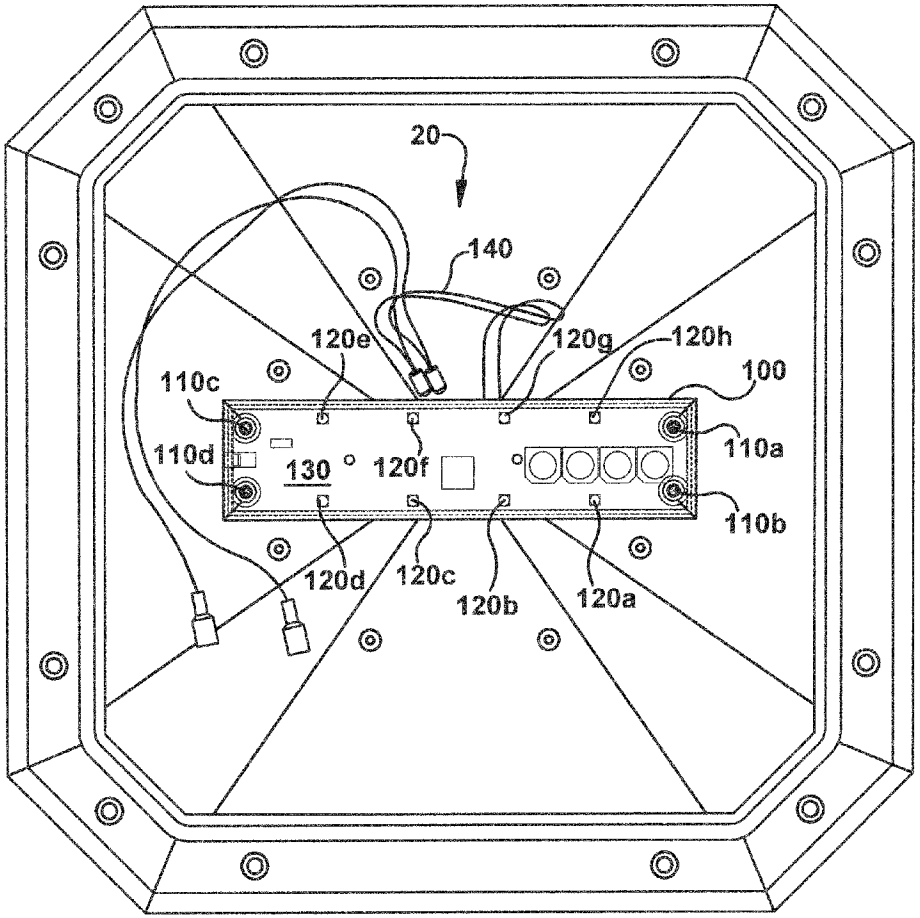
FIG. 2 is a top view of the marine power pedestal of FIG. 1, with an embodiment of a light assembly.

FIG. 2 is a top view of the light assembly 20 with the top cover removed. The light assembly 20 includes a housing 100. The housing 100 is affixed to the light assembly 20 with one or more fasteners 110*a*, 110*b*, 110*c*, and 110*d* (e.g., screws, clips, latches, adhesive). The housing 100 is constructed of a transparent material (e.g., glass, clear plastic, polymer construct). The transparent material allows light from LEDs 120*a*, 120*b*, 120*c*, 120*d*, 120*e*, 120*f*, 120*g*, and 120*h* to escape from the interior of the housing 100 and the light assembly 20. The LEDs 120*a*, 120*b*, 120*c*, 120*d*, 120*e*, 120*f*, 120*g*, and 120*h* are affixed to a substrate 130, such as a printed circuit board. The housing 100 also includes pigtails 140 that connects to an AC source.

Figure 3:
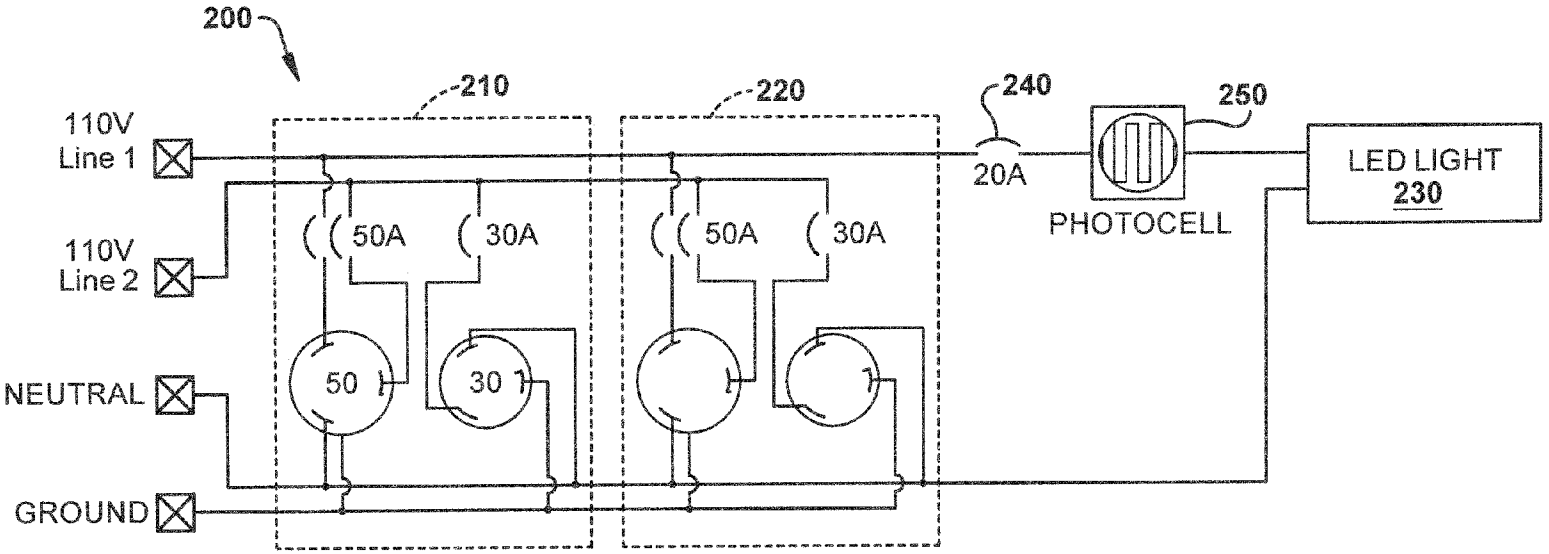
FIG. 3 is a schematic circuit diagram of one embodiment of a light assembly.

FIG. 3 is a schematic circuit diagram of one embodiment of a light assembly 200 associated with a marine power pedestal (not shown). The light assembly 200 has incoming electrical conductors including 110 volt (V) lines 1 and 2, a neutral line, and a ground line. The conductors feed two duplex receptacles 210 and 220. Each duplex receptacle 210 and 220 include a 30 amp and 50 amp receptacle. The duplex receptacles 210 and 220 allow the marine power pedestal to provide access to electrical power.

Line 1 also provides power to illuminate an LED light bank 230. The LED light bank 230 is on a circuit with an isolating fuse 240 and a photocell 250. The isolating fuse 240 protects the LED light bank 230 from an overcurrent event (e.g., short circuit, overloading, mismatched loads, device failure). The isolating fuse 240 prevents current flow to the LED light bank 230 by breaking down in the event of an overcurrent. For example, the isolating fuse 240 may contain a metal strip that melts when too much current flows through it. In this manner, the isolating fuse 240 may be a sacrificial part used to protect the LED light bank 230. In one embodiment, the isolating fuse 240 is an arrester designed to protect the LED light bank 230 from a lightening strike.

The photocell 250 detects ambient light to selectively remove power from the LED light bank 230. When the photocell 250 detects ambient light, power is interrupted to the LED light bank 230 causing the LED light bank 230 to be inactivated. Conversely, when the photocell 250 does not detect light, power flows to the LED light bank 230 causing the LED light bank 230 to be activated. The photocell 250 may also be programmable. For example, the photocell 250 may include a secondary activator (e.g., timer, RF remote receiver) that adds an additional control component to activate the LED light bank 230. Therefore, in addition to the detection of ambient light, the LED light bank 230 may be activated on a timed schedule or by remote control.

Figure 4A:
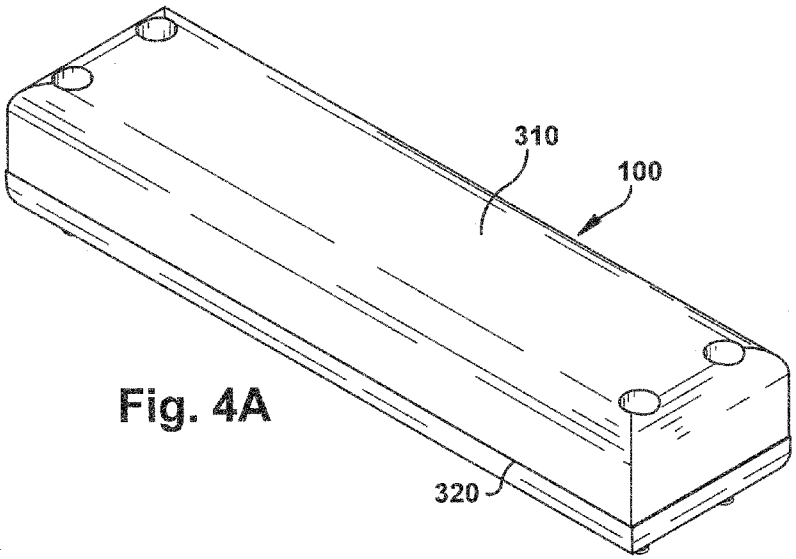
FIG. 4A is a perspective view of one embodiment of a housing.

FIG. 4A is a perspective view of one embodiment of the housing 100. The housing 100 includes an upper casing 310 and a lower casing 320. The upper casing 310 and/or the lower casing 320 are constructed of a transparent material (e.g., glass, clear plastic, polymer construct). The transparent material allows light from interior LEDs to escape from the interior of the housing 100. If light is intended to escape from the upper region of the housing, the upper casing 310 may be constructed of a transparent material while the lower housing 320 is constructed of an opaque or translucent material. Alternatively, the housing 100 may be configured to allow LEDs to be positioned in both the upper and lower regions of the housing 100. Accordingly, both the upper casing 310 and the lower casing 320 are constructed of a transparent material to allow light to be emitted 360° around the housing 100. The transparent material may also be clear, translucent, or semi-transparent.

Figure 4B:
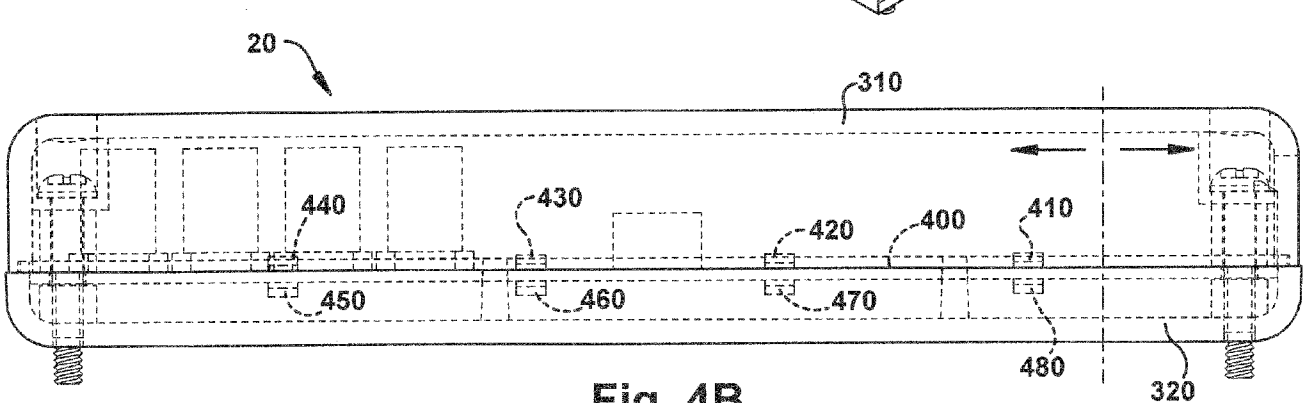
FIG. 4B is a side view of one embodiment of a housing.

FIG. 4B is a side view of one embodiment of the housing 100. The housing 100 encloses a substrate 400. LEDs 410, 420, 430, 440, 450, 460, 470, and 480 are mounted to the substrate 400. The housing 100 protects the substrate 400 from environmental contaminants (e.g., precipitation, moisture, insects, small animals, salt water, high winds) that the substrate 400 is susceptible to in the power pedestal environment.

In one embodiment, the substrate 400 is a printed circuit board (PCB). LED lights 410, 420, 430, 440, 450, 460, 470, and 480 may affixed to both sides of the PCB 400. For example, LED lights 410, 420, 430, and 440 are located on the upper portion of the PCB 400. LED lights 450, 460, 470, and 480 are located on the lower portion of the PCB 400. Affixing LED lights 410, 420, 430, 440, 450, 460, 470, and 480 to both sides of the PCB 400 allows light to exit the housing 100 from all angles, such that a larger area can be illuminated by marine power pedestal.

Figure 5:
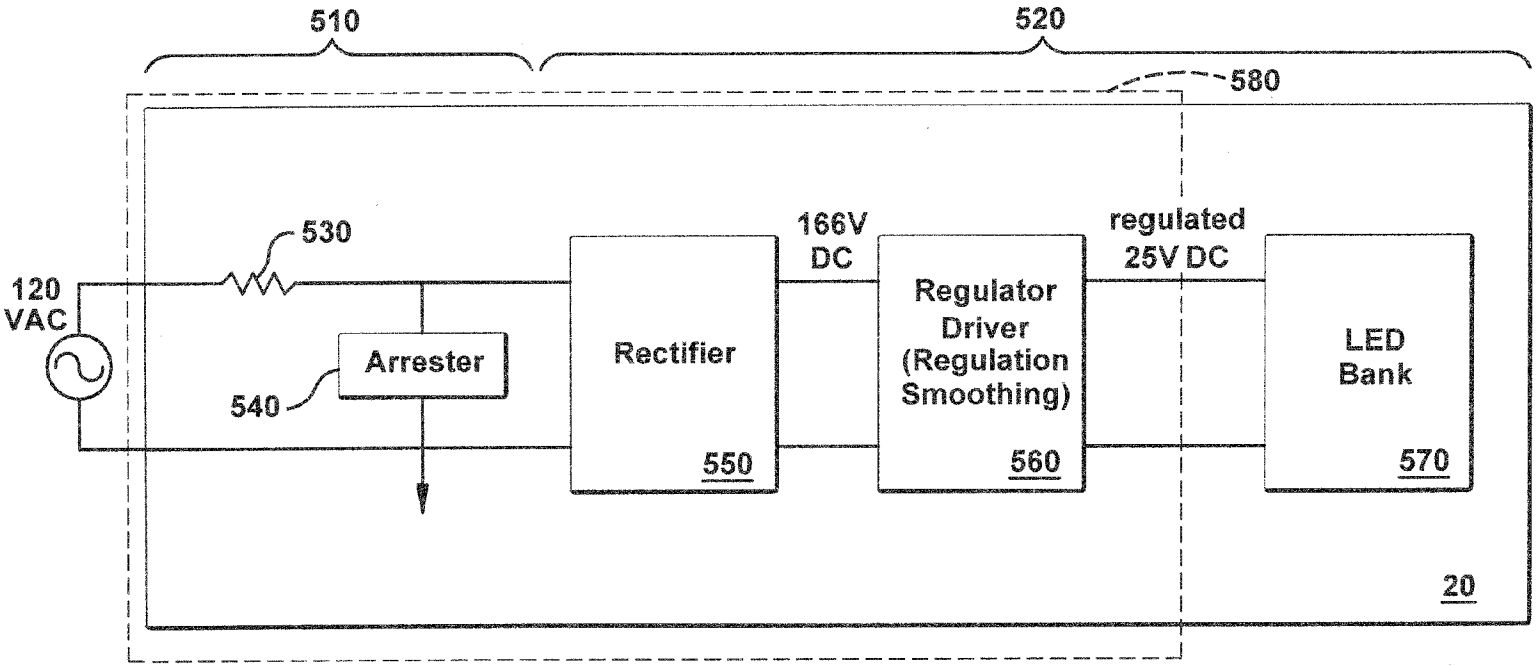
FIG. 5 is a functional block diagram of one embodiment of a light driver associated with a light assembly.

FIG. 5 is a circuit diagram of one embodiment of the light assembly 20. The light driver has an alternating current (AC) portion 510 and a direct current (DC) portion 520. The AC portion 510 is configured to receive 120V AC. The AC portion 510 includes a resistor 530 and an arrester 540. The resistor 530 controls current through the AC portion 510. The arrester 540 protects light assembly 20 from lightning strikes. The light assembly 20 is housed in a marina power pedestal (not shown) which is an outdoor device that is subject to environmental elements including lightning. The arrester 540 diverts excess electrical current to ground in the event of a lightning strike.

Because LED lights operate using DC power, the AC power in AC portion 510 must be converted to DC power in the DC portion 520. AC components and DC components are separated by a minimum distance. For example, the Underwriters Laboratories Inc. (UL) safety standards for the separation between AC components and DC components mandate such a separation. The AC components are separated from the DC components by at least the mandated distance on the PCB. For example, in one embodiment, spacing for the LED light with a driver were evaluated per the Standard for insulation Coordination Including Clearances and Creepage Distances for Electrical Equipment, UL 840, Tables 8.1, 9.1 for an Over-voltage category II, and the Canadian Standards for Insulation Coordination, CSA C22.2 No. 0.2 Pollution Degree 3 environment (suitable for dry and damp locations), and General Use power Supplies, CSA C22.2 No, 107.1, Tables 5 and 7.

The DC portion 520 includes a rectifier 550, and a regulator 560. The rectifier 550 converts AC power to DC power. For example, the rectifier 550 receives 120V AC and outputs 166V DC. The rectifier 550 may be a vacuum tube diode, mercury-arc valve, solid-state diode, silicon-controlled rectifier, or other silicon-based semiconductor switch.

The regulator 560 regulates the current flowing to the LED bank 570. For example, the regulator 560 receives 166V DC as input power and outputs 25V of regulated DC power. The regulated power provides regulated smooth power to the LED bank 570. The LED bank 570 includes a number of LED lights. The regulator 560 is located on the same circuitry as the LED bank 570 rather than being fabricated separately. Therefore, additional wiring between the regulator 560 and the LED bank 570 is unnecessary.

The resistor 530, the arrestor 540, the rectifier 550, and the regulator 560 form a driver 580 to control the LED bank 570. The LED bank 570 and the driver 580 can be implemented on the same PCB despite having both an AC portion 510 and a DC portion 520, thereby reducing fabrication time and cost as well as reducing the need for additional linking components.

References to "one embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in one embodiment" does not necessarily refer to the same embodiment, though it may.

While example systems, methods, and so on have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on described herein. Therefore, the disclosure is not limited to the specific details, the representative apparatus, and illustrative examples shown and described. Thus, this application is intended to embrace alterations, modifications, and variations that fall within the scope of the appended claims.

To the extent that the term "includes" or "including" is employed in the detailed description or the claims, it is intended to be inclusive in a manner similar to the term "comprising" as that term is interpreted when employed as a transitional word in a claim.

To the extent that the term "or" is used in the detailed description or claims (e.g., A or B) it is intended to mean "A or B or both". When the applicants intend to indicate "only A or B but not both" then the phrase "only A or B but not both" will be used. Thus, use of the term "or" herein is the inclusive, and not the exclusive use. See, Bryan A. Garner, A Dictionary of Modern Legal Usage 624 (2d. Ed. 1995).

To the extent that the phrase "one or more of, A, B, and C" is used herein, (e.g., a data store configured to store one or more of, A, B, and C) it is intended to convey the set of possibilities A, B, C, AB, AC, BC, and/or ABC (e.g., the data store may store only A, only B, only C, A&B, A&C, B&C, and/or A&B&C). It is not intended to require one of A, one of B, and one of C. When the applicants intend to indicate "at least one of A, at least one of B, and at least one of C", then the phrasing "at least one of A, at least one of B, and at least one of C" will be used.

What is claimed is:

1. A system, comprising: a substrate enclosed by a housing, where the housing is configured to prevent intrusion of environmental contaminants; at least one light emitting diode (LED) mounted to the substrate, where the at least one LED is configured to receive direct current (DC) power; and a driver mounted to the same substrate, where the driver is configured to control the at least one LED, and where the driver is configured to receive analog current (AC) power.

2. The system of claim 1, where the same substrate is a printed circuit board (PCB).

3. The system of claim 1, where the driver is configured to convert AC power to DC power.

4. The system of claim 1, where the driver and the at least one LED are separated by a predetermined distance on the same substrate.

5. The system of claim 1, where the housing is transparent or translucent.

6. The system of claim 1, where the at least one LED is a plurality LEDs configured to be controlled by the driver, where a first portion of the plurality of LEDs is located on a first face of the same substrate, and where a second portion of the plurality of LEDs is located on a second face of the same substrate.

7. The system of claim 1, where the driver is programmable to cause automatic activation of the at least one light in response to a predetermined event.

8. The system of claim 7, where the predetermined event includes a scheduled time, loss of ambient light, an output of a solar sensor, or reception of a remote signal.

9. The system of claim 1, where the driver has an arrester, where the arrester is configured to protect the at least one LED from a lightning strike.

10. A light assembly, comprising: a sealed housing configured to prevent intrusion of environmental contaminants; a substrate mounted within the sealed housing, the same substrate having at least one LED and a driver, where the at least one LED is configured to receive DC power; and pigtails wired to the same substrate, where the pigtails are configured to provide the driver with AC power.

11. The light assembly of claim 10, where the same substrate is a PCB.

12. The light assembly of claim 10, where the driver is configured to convert AC power to DC power.

13. The light assembly of claim 10, where the driver and the at least one LED are separated by a predetermined distance on the same substrate.

14. The light assembly of claim 10, where the sealed housing is transparent or translucent.

15. The light assembly of claim 10, where the at least one LED is a plurality LEDs configured to be controlled by the driver, where a first portion of the plurality of LEDs is located on a first face of the same substrate, and where a second portion of the plurality of LEDs is located on a second face of the same substrate.

16. The light assembly of claim 10, where the driver is programmable to cause automatic activation of the at least one light in response to a predetermined event.

17. The light assembly of claim 16, where the predetermined event includes a scheduled time, loss of ambient light, an output of a solar sensor, or reception of a remote signal.

18. The light assembly of claim 10, where the driver includes an arrester, where the arrester is configured to protect the at least one LED from a lightning strike.

* * * * *